US008294010B2

(12) United States Patent
Gillett

(10) Patent No.: US 8,294,010 B2
(45) Date of Patent: Oct. 23, 2012

(54) STRINGED MUSICAL INSTRUMENT

(76) Inventor: Michael Gillett, Wedmore (GB)

( * ) Notice: Subject to any disclaimer, the term of this patent is extended or adjusted under 35 U.S.C. 154(b) by 0 days.

(21) Appl. No.: 12/919,606

(22) PCT Filed: Feb. 26, 2009

(86) PCT No.: PCT/GB2009/050197

§ 371 (c)(1),
(2), (4) Date: Sep. 9, 2010

(87) PCT Pub. No.: WO2009/106892

PCT Pub. Date: Sep. 3, 2009

(65) Prior Publication Data

US 2011/0005366 A1 Jan. 13, 2011

Related U.S. Application Data

(60) Provisional application No. 61/032,088, filed on Feb. 28, 2008.

(30) Foreign Application Priority Data

Feb. 28, 2008 (GB) ..... 0803626.1

(51) Int. Cl.
*G10D 3/00* (2006.01)

(52) U.S. Cl. ..... 84/291

(58) Field of Classification Search ..... 84/291
See application file for complete search history.

(56) References Cited

U.S. PATENT DOCUMENTS

| | | | | |
|---|---|---|---|---|
| 1,010,240 | A | 11/1911 | Degulio | |
| 2,046,331 | A | 7/1936 | Loar | |
| 3,892,159 | A | 7/1975 | Houtsma | |
| 4,253,371 | A | 3/1981 | Guice | |
| 4,793,233 | A | 12/1988 | Olthoff | |
| 5,260,505 | A | 11/1993 | Kendall | |
| 5,661,252 | A | 8/1997 | Krawczak | |
| 5,895,872 | A | 4/1999 | Chase | |
| 5,955,688 | A * | 9/1999 | Cook | 84/291 |
| 6,333,454 | B1 * | 12/2001 | Griffiths | 84/291 |
| 6,459,024 | B1 | 10/2002 | Baker | |
| 2007/0234872 | A1 | 10/2007 | Cody | |
| 2008/0028910 | A1 | 2/2008 | Shellhammer | |

FOREIGN PATENT DOCUMENTS

| | | |
|---|---|---|
| JP | 11143456 | 5/1999 |
| WO | WO 92/10829 | 6/1992 |
| WO | WO 93/04463 | 3/1993 |
| WO | WO 97/04438 | 2/1997 |

* cited by examiner

*Primary Examiner* — Jeffrey Donels
(74) *Attorney, Agent, or Firm* — King & Schickli, PLLC

(57) ABSTRACT

A Stringed Musical Instrument A stringed musical instrument having a body includes a soundboard (602, 202) and a bridge (250) directly or indirectly connected to the soundboard via a frame (216, 518, 220, 222, 224) that is at least partially fitted within the body of the instrument.

28 Claims, 10 Drawing Sheets

Plan

Section a-a

STRINGED MUSICAL INSTRUMENT

This application is the national stage of PCT/GB2009/050197, filed Feb. 26, 2009, which claims priority from British Patent Application Ser. No. 0803626.1, filed Feb. 28, 2008 and U.S. Provisional Application Ser. No. 61/032,088, filed Feb. 28, 2008.

FIELD OF THE INVENTION

The present invention relates to stringed musical instruments.

BACKGROUND OF THE INVENTION

An example of the construction of a conventional acoustic guitar is shown in the partial diagram of FIG. 1. The bottom/rear surface 102 of the guitar includes a peripheral wall 104 running around the outer edge of its inner surface. To provide strength and support to the bottom various bracings are required. In the illustrated example a set of bracings 106 run from side to side and a further bracing 107 runs between the bottom and the top of the bottom surface of the guitar. The top/upper surface 108 of the guitar also includes a series of bracings 110 which, in the example, run diagonally. The bottom 102 and top 108 are connected together by means of vertical struts (visible at 112) arranged around the inner surface of the side wall 114. The top 108 of the guitar includes the bridge 116 that is connected to one end of the strings 118 (the ends are connected at the head stock 120). The bridge 116 supports the strings and transmits the vibration of the strings to the body of the guitar, thus producing louder sounds.

The tension in the strings 118 passes through the body of the guitar and necessitates the various bracings. However, the present inventor has found that such bracings can affect/be detrimental to the quality of the sound produced by the instrument.

SUMMARY OF THE INVENTION

Embodiments of the present invention provide a stringed musical instrument that produces a desirable tone and can eliminate the need for bracings on the top/bottom surfaces. This can enable a wide range of materials to be used for construction of the top and bottom surfaces of the instrument.

According to a first aspect of the present invention there is provided a stringed musical instrument having a body including a soundboard, the instrument including a bridge indirectly or directly connected to the soundboard via a frame at least partially fitted within the body of the instrument.

A first part of the frame may be connected to a portion of the body at or adjacent its shoulder/neck end and another part of the frame may be connected to a portion of the body at or adjacent a body end opposite the shoulder/neck end. The frame may include a platform for supporting the bridge and a plurality of members extending therefrom that connect the platform to the body. Thus, a top of the body may or may not move/vibrate independently of the bridge. The frame can absorb tension from strings of the instrument. The frame can be formed of different materials than at least part of the body.

A pair of said frame members may extend from the platform to an upper portion of a neck end portion of the body, and a first one of the pair of members may be located one side of a neck location and the other one of the pair may be located another side of the neck location. A further said frame member may extend from the platform to a lower portion of the neck end portion of the body, and may be located below the neck portion, between the pairs of frame members. At least one said frame member may extend from the platform to a part of the body opposite the shoulder/neck end. A said frame member extending to a lower portion of the part of the body opposite the shoulder/neck end may include a plurality of bores, each said bore configured to accommodate a string of the instrument. At least one of the frame members extending to the part of the body opposite the neck end may be connected to a cross piece that extends across a bottom of the body.

The body may include a top and a bottom connected together by a plurality of members arranged around the periphery of the body top and bottom. The body top and bottom connecting members may include a set of spaced-apart elongate members, e.g. a set of A-frames. The body may further include a side wall connected between the top and the bottom, but not connected to the top and bottom connecting members. As the string tension is absorbed by the frame, the top and/or the bottom may not include bracings configured to absorb string tension. The top may be connected to the frame member and can, optionally, include an aperture through which the bridge protrudes. The soundboard (e.g. which can include the top, or the top and bottom) can be connected to the frame by at least one transmitter component, which may be formed of softwood.

A shoulder/neck end portion of the body may be formed of a solid/non-hollow member, which may be formed of a plurality of pieces fixed together. The instrument may further include a rim member arranged around at least part of a periphery of an inner surface of a top and/or bottom of the body.

The bottom of the body may include a recessed portion configured to, in use, accommodate part of a leg of a player. The rim member may run around an inner boundary of the bottom recessed portion. The top of the body may include a recess in a region configured to, in use, accommodate a wrist of a player.

The instrument may comprise a bass guitar, but it will be appreciated that the principle can be applied to other instruments, such as other types of 6-stringed instruments.

According to another aspect of the present invention there is provided a frame adapted to indirectly or directly connect a bridge to a soundboard of a stringed musical instrument, the frame, in use, being at least partially fitted within the body of the instrument. According to yet another aspect of the present invention there is provided a stringed musical instrument body configured to receive the frame.

According to a further aspect of the present invention there is provided a musical instrument bridge substantially as described herein.

Whilst the invention has been described above, it extends to any inventive combination of features set out above or in the following description. Although illustrative embodiments of the invention are described in detail herein with reference to the accompanying drawings, it is to be understood that the invention is not limited to these precise embodiments. As such, many modifications and variations will be apparent to practitioners skilled in the art. Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

BRIEF DESCRIPTION OF THE DRAWING FIGURES

The invention may be performed in various ways, and, by way of example only, embodiments thereof will now be described, reference being made to the accompanying drawings in which.

DETAILED DESCRIPTION OF THE INVENTION

Figure 2A:
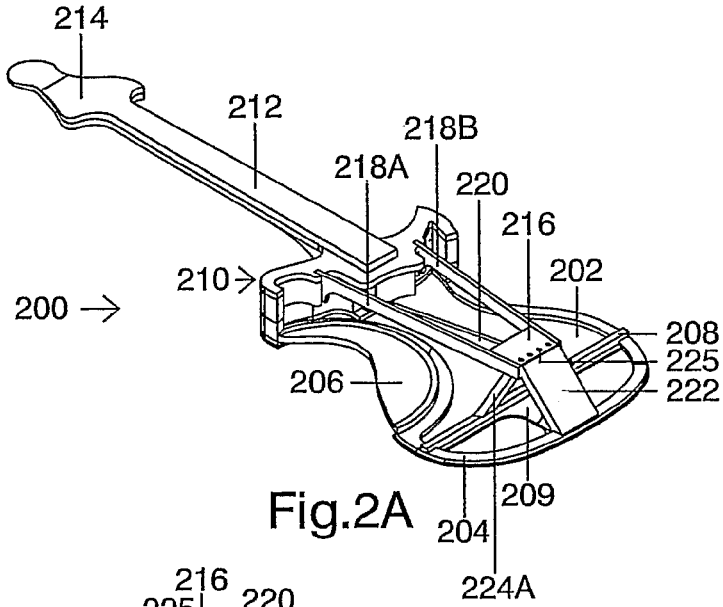
FIGS. 2A and 2B are perspective drawings of an embodiment of the stringed musical instrument, not including certain components located at the periphery and top of the instrument for clarity.
Figure 2B:
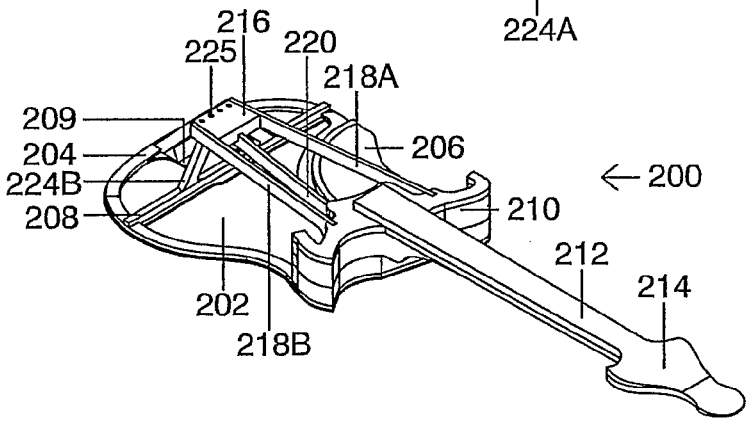
Figure 3:
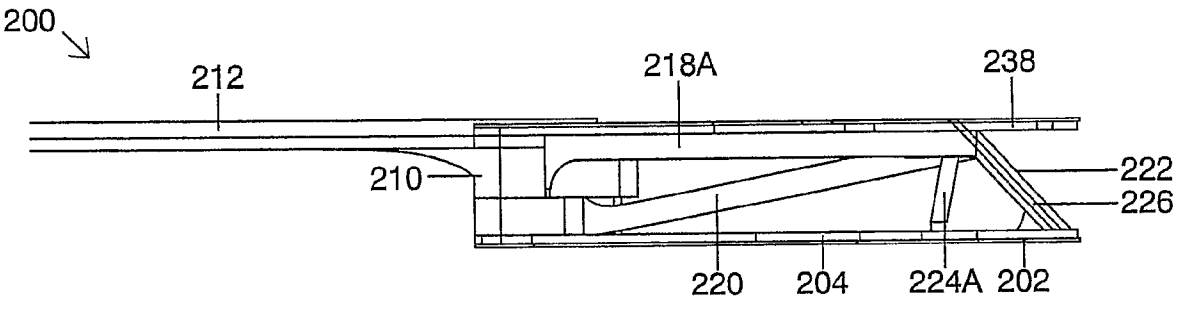
FIG. 3 is a side view of the instrument, not including certain components located around the periphery of the instrument.
Figure 4:
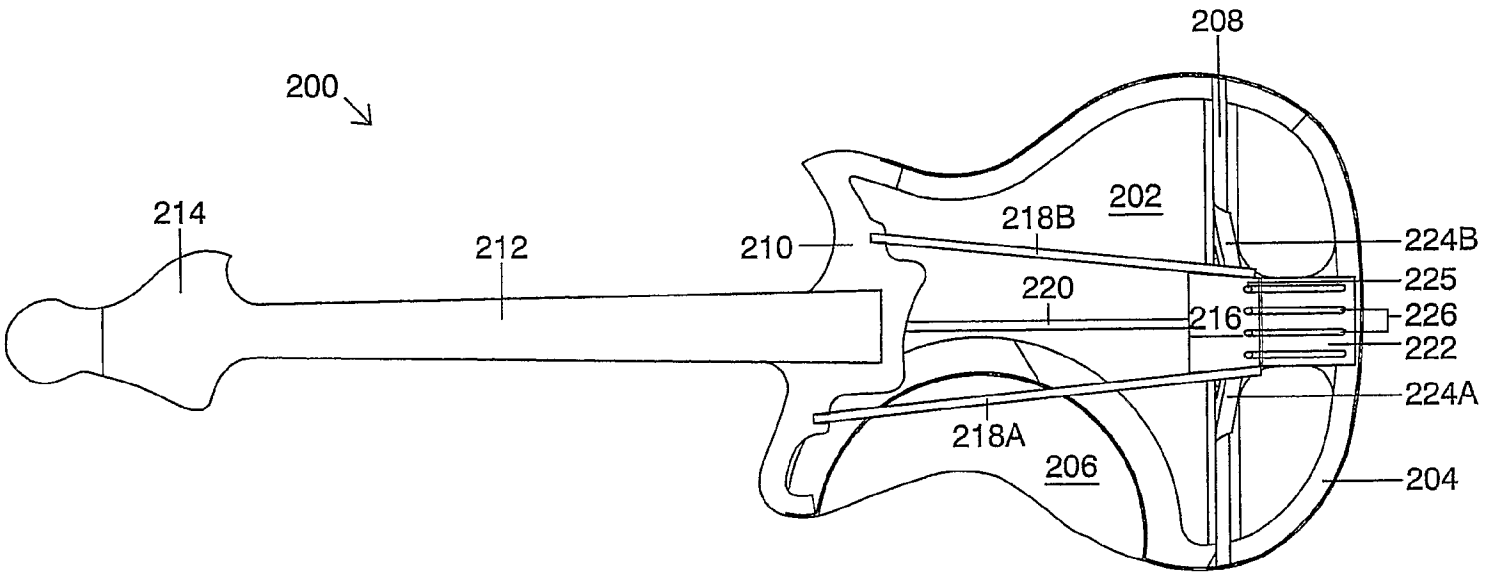
FIG. 4 is a plan view of the instrument, not including certain components located at the top of the instrument.

Referring to FIGS. 2 to 4, a first example 200 of a stringed musical instrument is shown. The example instrument is a bass guitar, although it will be appreciated that the construction principles described herein could be used with other types of guitars (including electric ones) or stringed instruments. In the example, the bottom surface 202 of the guitar is formed of 3 mm thick Sitka spruce. As with many conventional guitars, the bottom is shaped to include a waist; however, it will be appreciated that the dimensions, design and materials of the guitar bottom (as well as the other components) can vary and the details given herein should be taken as examples only.

Running around a large proportion of the periphery of the bottom 202 is a peripheral frame 204. The peripheral frame may be formed of at least one 15 mm×6 mm maple piece and can act as a rigid "skeleton" for the outer edge of the bottom surface 202, but does not cross the main/central area of the body as is the case with the conventional bracings shown in FIG. 1.

The bottom 202 further includes a recessed portion 206 that curves upwards into the body of the guitar (to a depth of around 38 mm). The portion 206 can be a separate piece (e.g. formed of Jelutong) connected to the rest of the bottom 202, or in other embodiments the bottom may be formed with an integral recessed portion. In use, the recessed portion can accommodate part of a player's anatomy, e.g. his/her thigh, thereby improving comfort. It will be noted that the peripheral frame 204 runs along the boundary of the recessed portion 206 with the remainder of the bottom surface 202, and not around the outer periphery of the recessed portion 206.

A cross piece 208 (which may comprise upper and lower sections) runs from side to side of the bottom surface 202, at a point around one quarter of the way along from its base end. The cross piece 208 may be fixed to the inner surface of the guitar bottom 202 and can be glued at its ends to parts of the peripheral frame 204. A base portion 209 may connect a central portion of the cross-piece 208 to a part of the peripheral frame 204 at the base end of the guitar.

The shoulder of the guitar is formed of a substantially solid portion 210, as described in more detail below. A neck 212 extends outwardly from the shoulder portion, leading to a headstock portion 214. The neck supports a fingerboard 213. String length can be increased by the distinctive headstock design, where there is a further—compared with conventional designs—70 mm (approximately) from the nut to the fourth (E) string machine head. There is a distance of around 150 mm to the second (D) string machine head.

The guitar 200 further includes a platform 216 that is intended to support a bridge (bridge not shown in FIGS. 2 to 4). The platform 216 may be formed of mahogany. A first elongate frame member 218A is connected to the left hand (in FIG. 2A and FIG. 4) side edge of the platform 216. The frame member 218A is formed of maple, but it will be understood that alternative materials could be used for member 218A as well as other parts that support the platform 216. The frame member 218A extends diagonally outwardly towards the left hand side of the guitar, in a direction substantially parallel with that of the neck 212. The end of the member 218A can be fixed (e.g. by gluing and pinning using 4×8 mm dowell pins) to an upper portion of the shoulder 210 by any suitable means, e.g. adhesive. A second upper elongate frame member 218B is connected to the right hand side of the platform 216 and is a mirror image of the first member 218A. The second member 218B extends diagonally to fit to a portion of the shoulder 210, towards the right hand side of the guitar. Thus, the two upper front frame members 218A, 218B are connected to the shoulder 210 at locations either side of the neck 212.

A third elongate frame member 220 is connected to a lower surface of the front of the platform 216 and extends downwardly (as best seen in FIG. 3) to fix to a lower portion of the shoulder 210. The ends of member 220 are connected to a substantially central portion of the platform 216 and the shoulder 210.

A further frame member 222 is connected to a rear edge of the platform 216. The rear frame member 222 extends downwardly and connects with a part of the peripheral frame 204 at the base end of the guitar. A further rear frame member 224A is connected to a lower surface of the platform 216, adjacent the left hand side of its rear end. The member 224A extends diagonally sideways to connect to the cross piece 208. A similar frame member 224B extends between the lower surface of the platform 216 and the cross piece at the right hand side of the platform. Thus, in the example the platform 216 is connected to the main body of the guitar at five points (i.e. the ends of the frame members 218A, 2188, 220, 222, 224A, 224B), although it will be understood that the number of contact points between the platform and the guitar body (as well as the design of the frame members) can be varied.

There is a set of four spaced apart bores 225 adjacent the rear edge of the platform 216. The bores extend diagonally to the rear end of the platform and are aligned with openings of a corresponding set of four bores 226 that run through the rear frame member 222 (visible in broken lines in FIG. 4). In use, the strings of the instrument pass through these sets of bores so that the ends of the strings can be fixed to a bridge (not shown) fixed on the headstock and another portion of the guitar, e.g. its lower surface. Thus, through body stringing can be achieved, which is not possible in conventional acoustic guitars, such as the one shown in FIG. 1. It will be appreciated that the number/dimensions of the bores could be altered to suit any type/number of strings used on the instrument.

Figure 5:
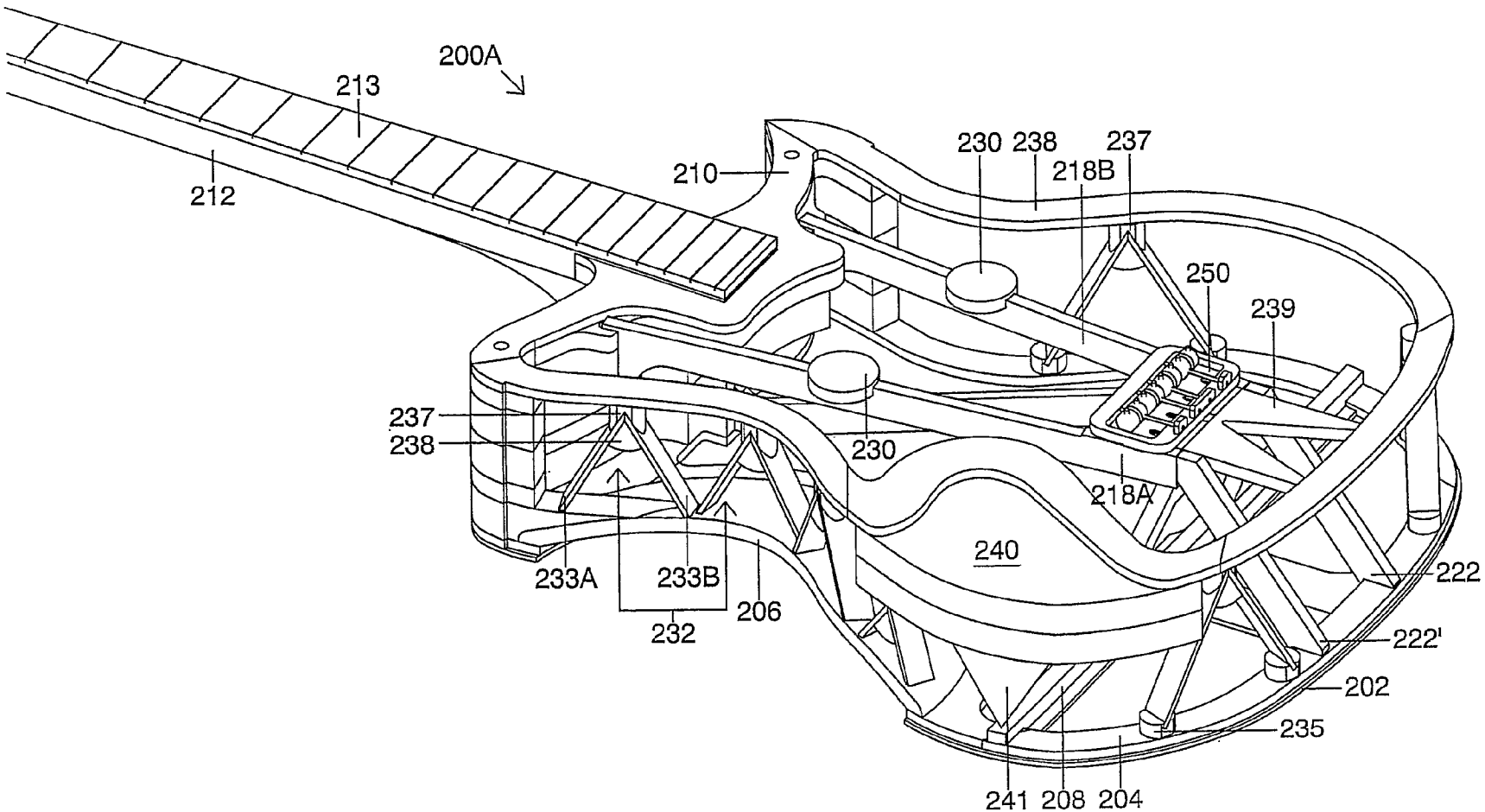
FIG. 5 is a perspective view of an alternative embodiment of the instrument, again not including certain components for ease of illustration.

Turning to FIG. 5, an alternative embodiment 200A of the guitar is shown. The same reference numerals are used for components that are substantially to those of embodiment 200. The main difference between guitar 200A and the one shown in the previous drawings is that instead of a single solid rear frame member 222 having the through body stringing holes 226, there are a pair of depending struts 222' used to connect the platform with the rear portion of the guitar body.

FIG. 5 also shows an example of connecting members that can be used to connect the bottom surface 202 of the guitar to a top surface (top surface not shown in FIG. 5). In the example, the connecting members comprise a set of spaced apart "A-frames" 232 that are arranged around the periphery of the bottom 202. Where the peripheral frame 204 is present at the outer edge of the bottom 202, the bottoms of the A-frames are connected to this (e.g. by glue and/or slot formations), but some of the A-frames are connected to the outer periphery of the recessed portion 206 (rather than the boundary between portion 202 and the rest of the bottom 202). Each A-frame comprises a pair of converging diagonal struts 233A, 233B, some of which have their lower ends connected to disc shaped pads 235. The upper ends of the struts 233A, 233B meet and are further connected to an upper generally cylindrical member 237. A segment-shaped piece 238 may be connected inside the apex of the two struts 233.

The upper ends of the cylindrical portions 237 present a series of vertically aligned circular surfaces upon which further components of the guitar body can be fixed, e.g. by means of gluing and/or fitting into appropriate slots. In the example an upper peripheral frame 238 is fixed on top of the cylindrical pieces 237. The shape of the upper peripheral frame 238 generally corresponds with the outline of the guitar top surface (top surface not shown in FIG. 5). Parts of the upper peripheral frame 238 can also be connected to/formed by the upper surface of the shoulder 210. A generally V-shaped member 239 can also connect the rear surface of the platform 216 to an adjacent portion of the upper peripheral frame 238, which can increase strength.

A wrist support 240 is fitted on top of some of the cylindrical portions 237. The wrist support takes the form of a piece of material, such as Jelutong, that is located at part of the periphery of the guitar, where, in use, a player can rest his wrist. A support 241 connects part 240 to the lower peripheral frame 204. The upper peripheral frame 238 may be formed so as to expose the majority of the upper surface of the wrist support. It will be appreciated that the dimensions and location of the wrist support (and the recessed lower surface portion 206) can be varied, e.g. to benefit left handed players.

The front upper frame members 218A, 218B can be fitted with members that are used to connect the top surface of the guitar to the platform 216 and so the top is indirectly (or optionally may be directly connected) connected to a bridge 250 mounted on the platform. In the example the top connecting members comprise a pair of disc-shaped pads 230, which can be formed of soft wood, mounted on upper surfaces of the forward frame members 218A, 218B. The pads can function as devices that transmit vibration of the bridge (via platform 216 and frame members 218) to the guitar top/soundboard. It will be understood that the number and position of the top connecting members/transmitters can vary from instrument to instrument, as they can affect the resultant tonal qualities (e.g. resonance and volume), allowing each instrument to be individually "tuned" by the placement of the transmitters. Sound enhancement can be achieved by placing transducers between the top skin's lower surface/undersurface and the transmitters' upper surface.

Figure 1:
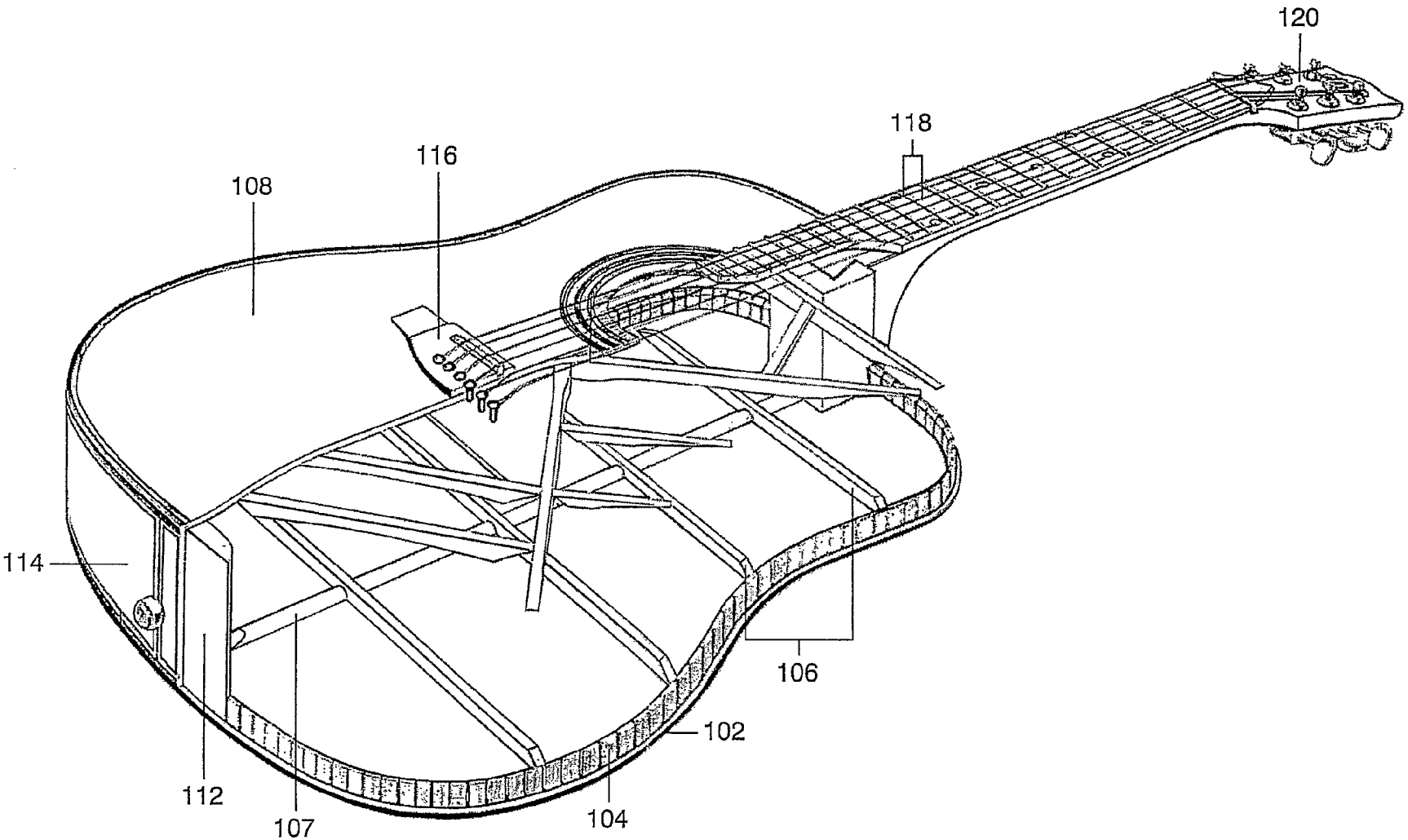
FIG. 1 is a partially cut-away drawing showing the construction of a conventional acoustic guitar.
Figure 6:
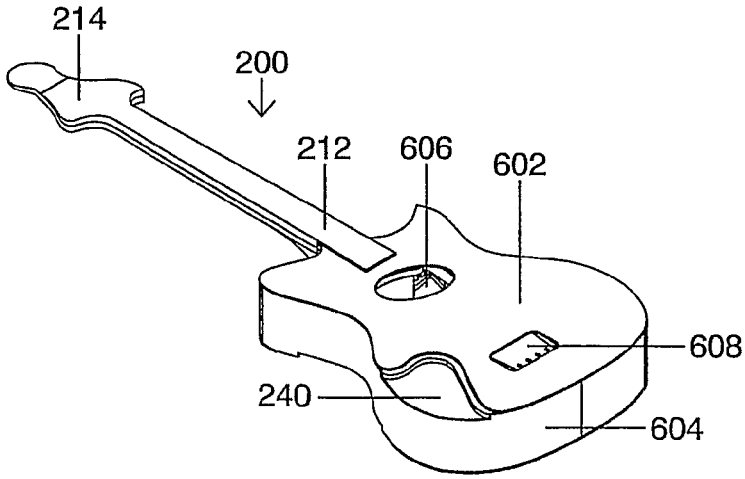
FIG. 6 is a perspective diagram of the musical instrument including a top component.

FIG. 6 shows the guitar with a top surface 602 connected. Note that the top 602 is connected (e.g. by glue) to the frame members by means of the pads 230 and the top is not fixed to the A-frames. Thus, vibration of the top 602 is mainly dependent upon the vibration of the bridge 250/platform 216 and the frame members, and the top can be considered to move (or "float") independently of the other components of the guitar body, such as the A-frames 232. Similarly, the bottom 202 of the guitar can be connected to the frame members 220, 222, 224A and/or 224B using at least one transmitter component. Thus, tension from the strings is distributed in a different way to conventional guitars, with no/little tension being absorbed by the top and/or bottom surfaces/body coverings of the guitar. Instead, the majority of the tension is borne by the solid shoulder 210 and the frame members. This means that bracings (as shown in FIG. 1) for the top/bottom surfaces are not required. The result can be a bass guitar that emulates the characteristics of the sound of a conventional double bass.

The top surface can include a sound hole 606 as well as a (rectangular) aperture 608 that allows access to the platform 216 with a 1 mm clearance or alternatively the bridge platform may be attached, e.g by screws, to the top surface. In alternative embodiments, e.g. electric guitars, the aperture 608 may not be present. Also shown in FIG. 6 are side walls 604 that extend between the bottom 202 and top 602 of the guitar. The side walls can be connected by glue to the lower 204 and upper 238 peripheral frames and will normally not be fixed to the A-frames 232. Thus, unlike conventional acoustic guitars, the side walls 604 can also be considered to be substantially free of bracings. The shape of the top surface generally corresponds with that of the upper peripheral frame 238 and so is cut away to expose the wrist support 240 so that the support can be around 28 mm deep from the upper surface of the top.

Figure 7:
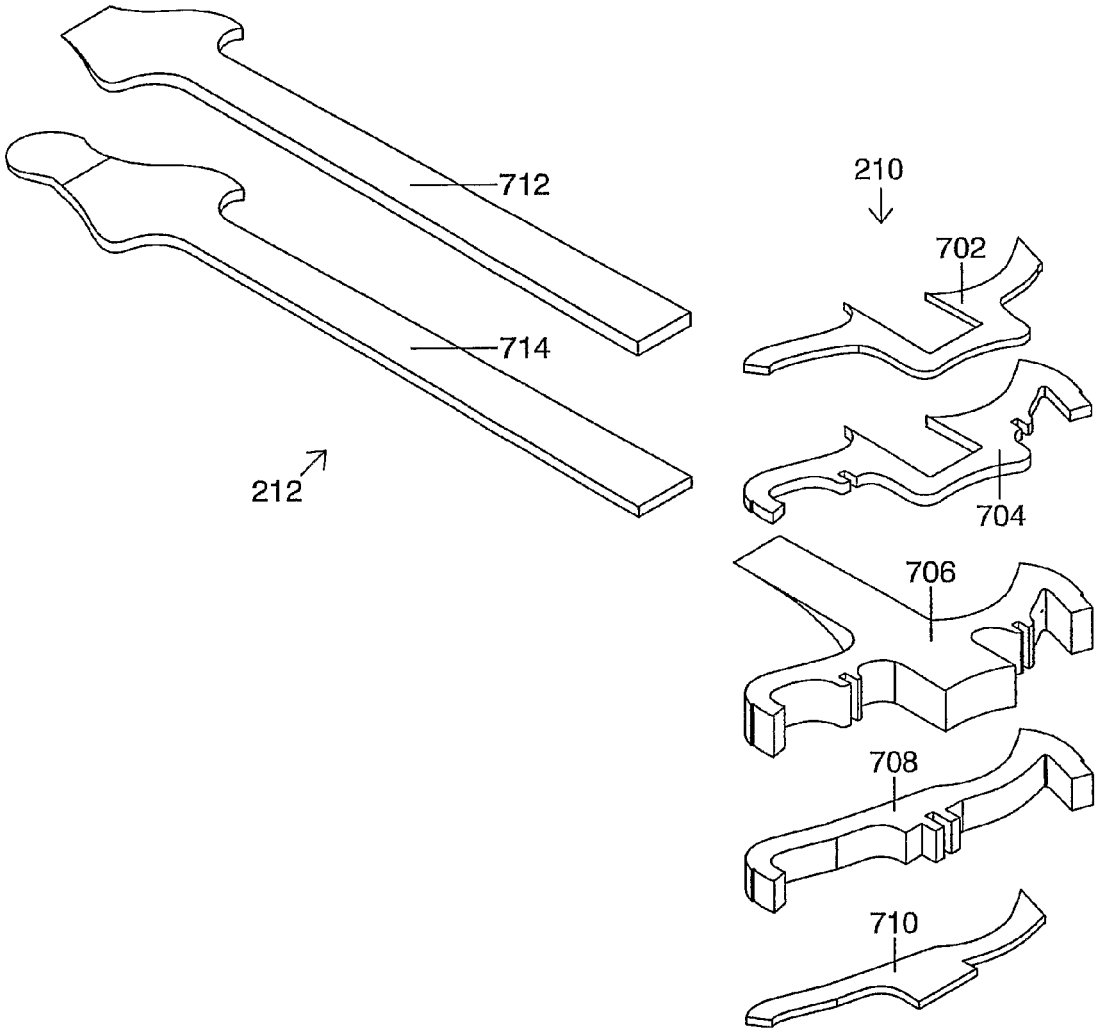
FIG. 7 illustrates components used to form shoulder and neck components of the instrument.

FIG. 7 shows an example of the construction of the shoulder 210. The shoulder can be fitted with an upper frame portion 702. Beneath this is a shoe piece 704, followed by a sole piece 706, which includes a heel/extension that connects to the neck. There is then a centre piece 708, followed by a lower anchor piece 710. Suitable materials for the construction of the shoulder are a "sandwich" of mahogany and maple (or maple and walnut) components, but it will be appreciated that variations in the dimensions, design and materials used are possible and in some cases the shoulder could be formed of one solid piece.

The example neck shown in FIG. 7 includes an upper portion 712 and a lower portion 714 that can be fixed together by means of glue, etc. The neck may be glued and dowelled to the shoulder 210.

Figure 8A:
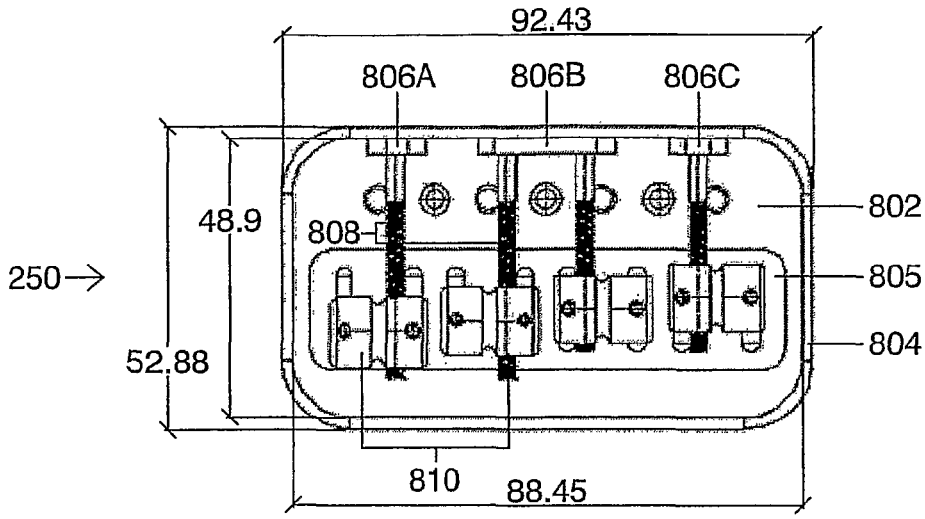
FIGS. 8A to 8C are plan, front and perspective views, respectively, of an example bridge for the instrument.
Figure 8B:
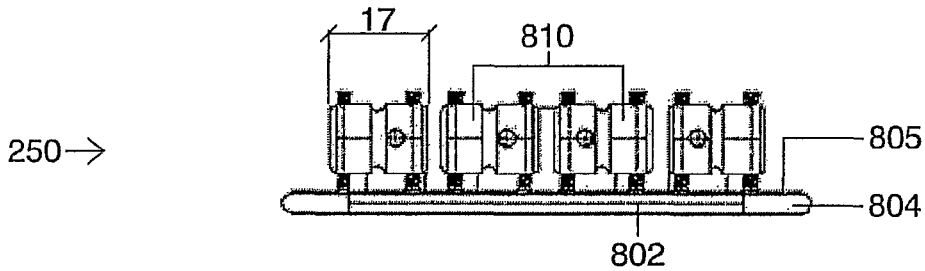
Figure 8C:
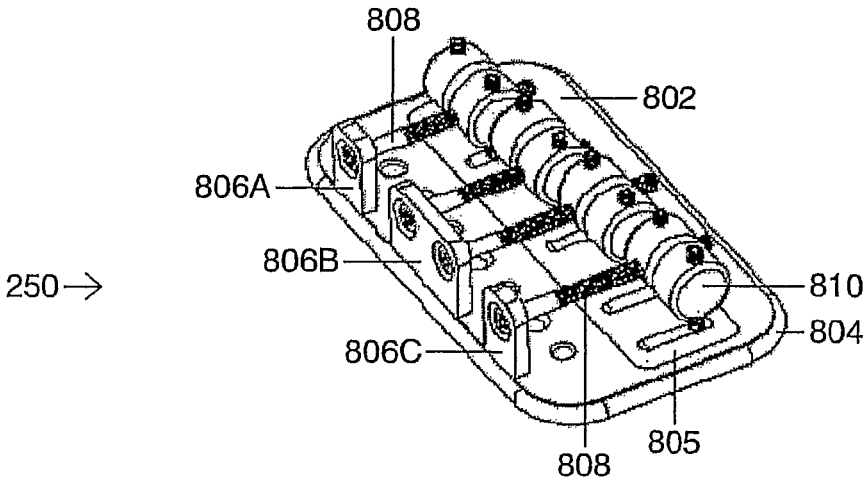

FIG. 8A to 8C illustrate an example of a bridge 250 that can be mounted on the platform 216 using any suitable means, e.g. adhesive or a nut/bolt arrangement. The bridge 250 includes a lower plate 802 that can be formed of aluminium alloy (or, e.g., TUFNOL), for example, and so is lightweight. The edges of the bridge are recessed for insertion of a silicone rubber insulation ring 804. The saddle 805 can be formed of an ivory substitute material. A set of three bridge protrusions 806A-806C can also be formed of aluminium alloy, and a set of four threaded members 808 extend perpendicularly from these. The threads on the members 808 can be formed of blackened steel. The other ends of the threaded members 808 are connected to a set of string saddles 810, which can be formed of an ivory substitute material. The support 812 for the saddles 810 can be formed of nylon. Having the bridge formed of a combination of aluminium and other materials means that its adjustability is greater than that of conventional steel-based bridges. This, especially in combination with the through-body stringing arrangement, means that a distinctive and attractive timbre can be produced.

Examples of the dimensions of the bridge component are shown in FIG. 8A.

Below are example dimensions for an embodiment of the instrument:

Overall length from top of headstock to far body edge 1086 mm

Overall body depth 103.5 mm

Internal depth between maple frames 87.5 mm

Internal depth of body 99.5 mm

Body width at shoulder 290 mm

Body width at bridge 402 mm

Body width at narrowest hip 239 mm

Body length measured at the rear central point 441 mm

Finger board length 504 mm

Width at nut 40 mm

Width at body end 60 mm

Scale length nut to saddle 30 inches

Fret numbers=18

At 18th fret string 1—C#; 2=G#; 3=Eb; 4=Bb

String spacings at the nut 10 mm; at the saddle 17.5 mm (taken at string centres)

Elliptical sound hole length 114 mm width 69 mm

Bridge elliptical aperture length 90 mm width 65 mm

Thickness of all Sitka Spruce body coverings 2 mm

Body contours:

Recessed rear 38 mm maximum depth

Wrist valley 28 mm maximum depth

End of neck to bridge platform edge 239 mm

Bridge saddle to far edge 129 mm

Headstock:

Length 190 mm, maximum width 120 mm, minimum at waist 43 mm, maximum at top of radius 58 mm Machine head spacings (from the nut to the centre of each machine head):

String 1 74 mm, 30 mm from right hand edge

String 2 153 mm, 22 mm from right hand edge

String 3 100 mm, 20 mm from left hand edge

String 4 70 mm, 25 mm from left hand edge

Figure 9A:
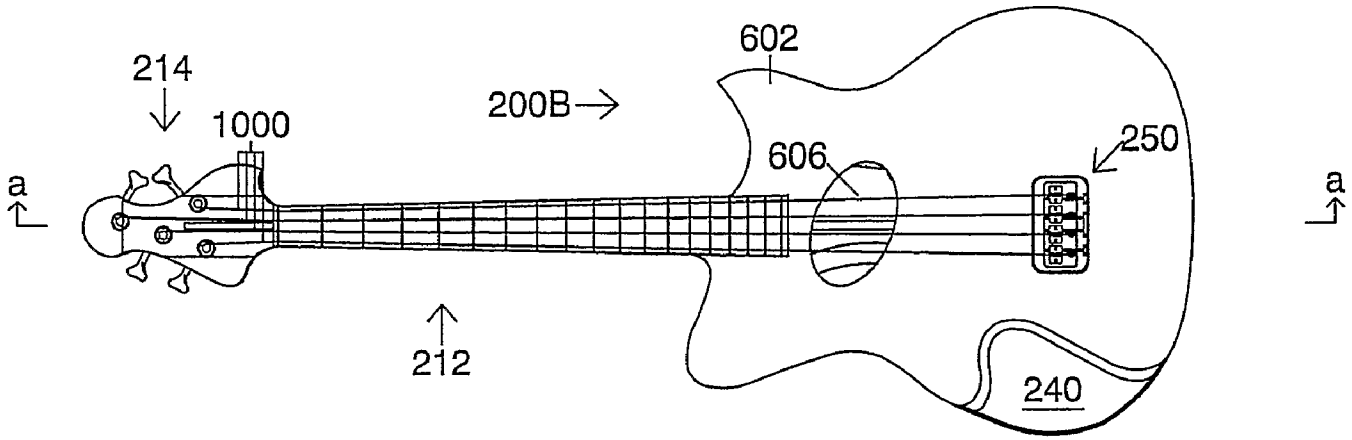
FIG. 9A is a plan view of an alternative embodiment.
Figure 9B:
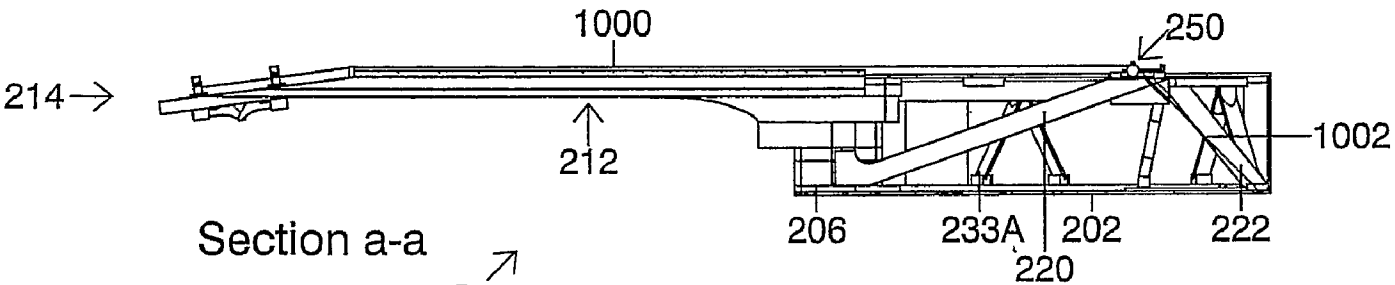
FIG. 9B is a sectional view through line a-a' of FIG. 9A.
Figure 9C:
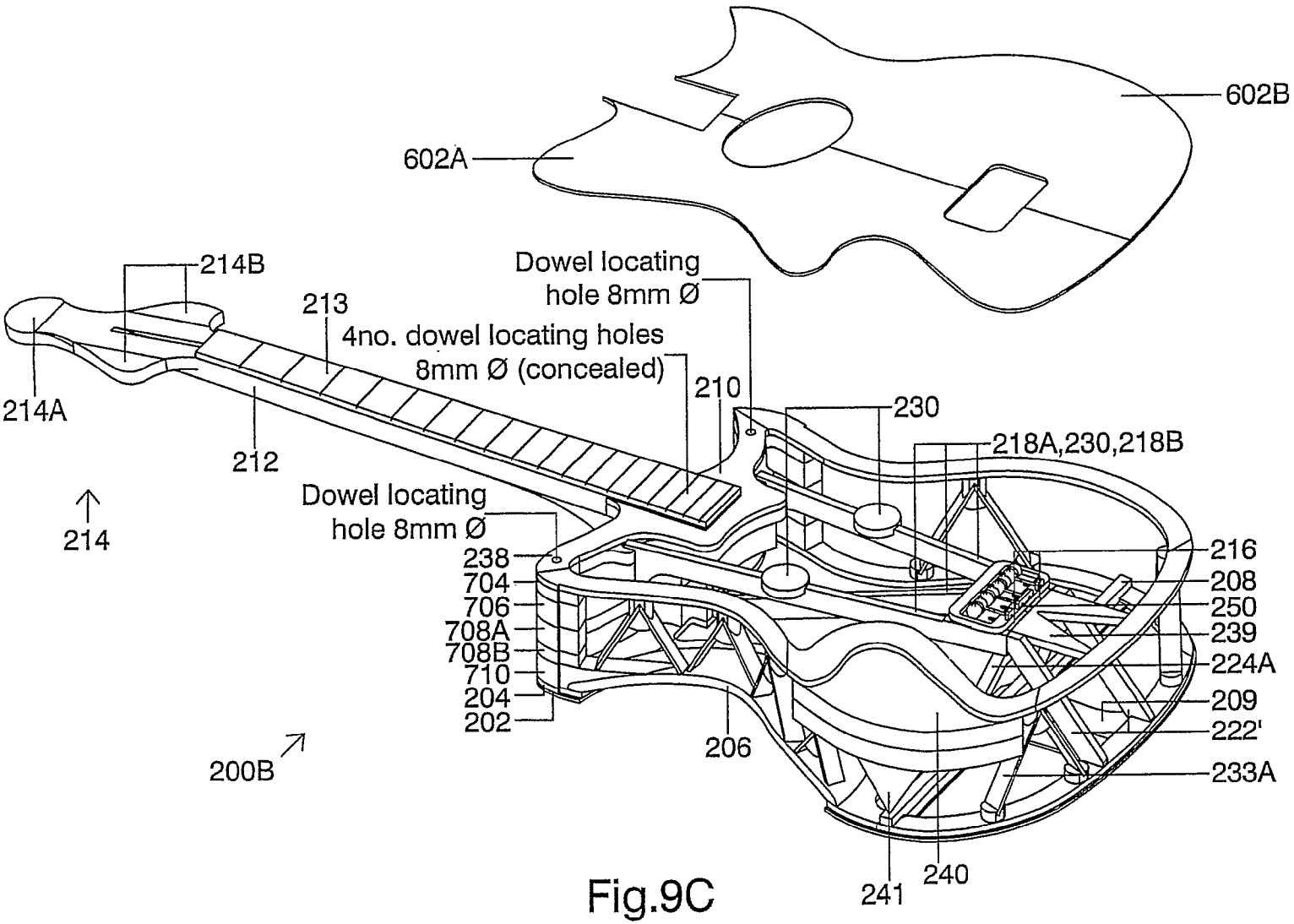
FIG. 9C is a partially-exploded perspective diagram of the embodiment of FIGS. 9A and 9B.

FIGS. 9A, 9B and 9C show another embodiment 200B of the stringed instrument. The main difference of this embodiment compared with the earlier figures is a deeper main body and identical reference numerals are used for corresponding components. The headstock comprises scarph 214A and a pair of wings 214B. The shoulder comprises upper 708A and lower 708B centre pieces. The strings 1000 (four strings in the example) of the instrument are shown in FIGS. 9A and 9B. The line of the strings passing through the body is shown at 1002. The top surface/skin in the example of FIG. 9 is formed of two halves 602A, 602B.

Figure 10:
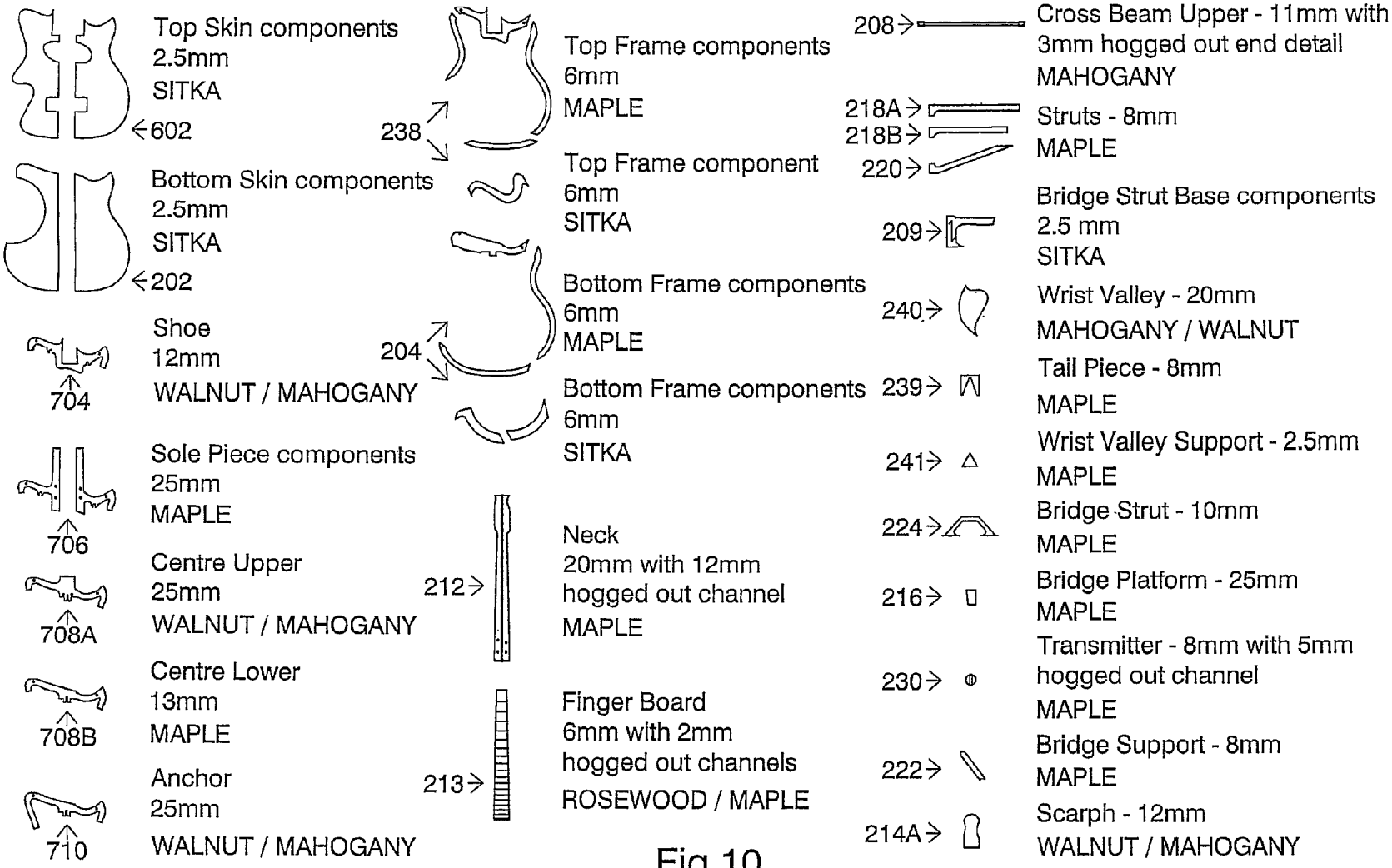
FIG. 10 illustrates some of the individual components that can be used to construct an embodiment of the instrument.

FIG. 10 shows examples of some of the individual components that can form the guitar.

Figure 11:
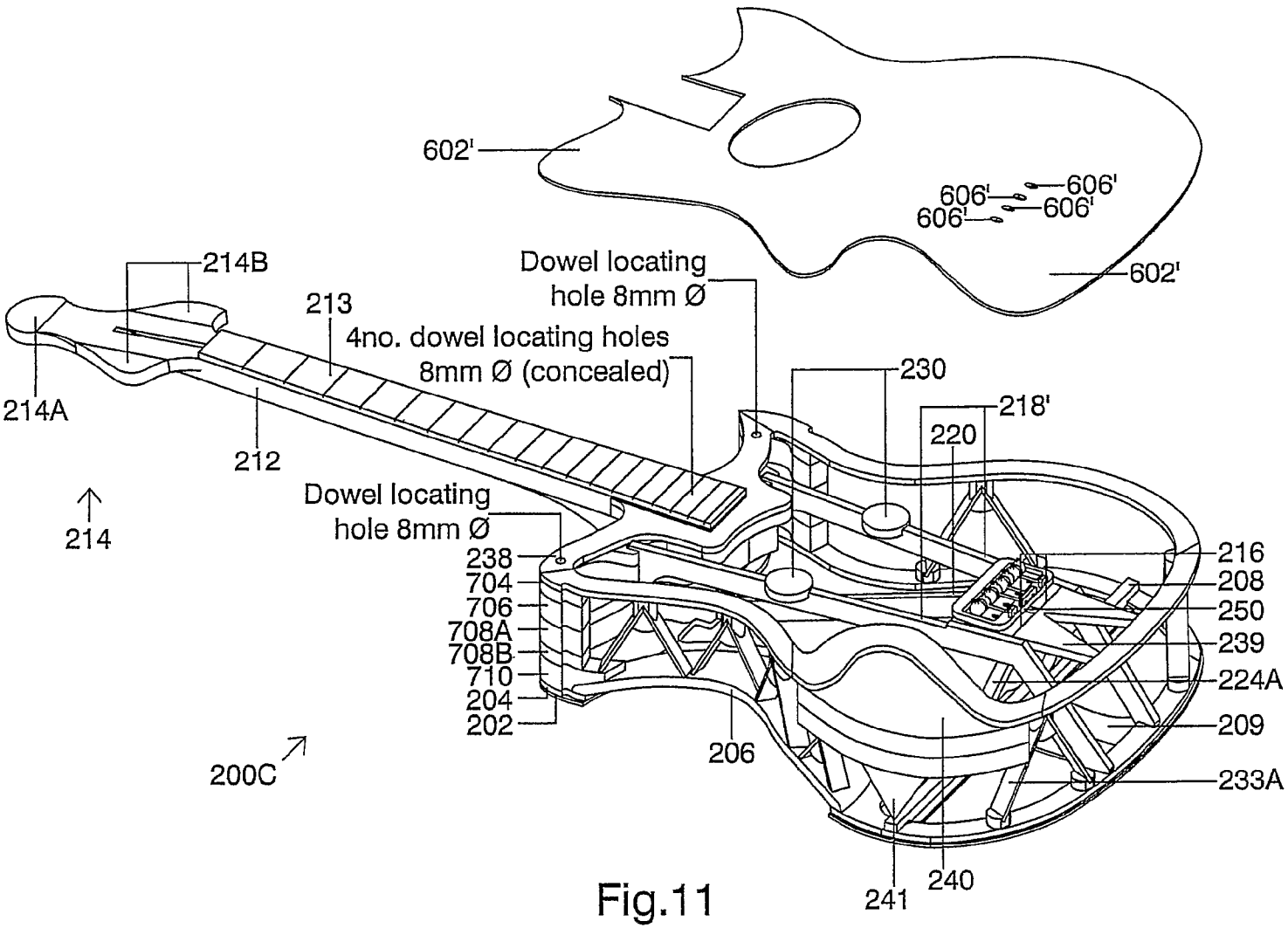
FIG. 11 is partially-exploded perspective diagram similar to FIG. 9C that shows yet another alternative embodiment of the instrument.

FIG. 11 shows yet another version 200C of the guitar. The main differences between guitar 200C and the ones shown in the previous drawings include: instead of a single large aperture (e.g. 606) through which substantially all of the bridge mounted on the platform 216 protrudes, there are a series of four individual apertures 606' through which the strings of the instrument are passed; instead of two separate diagonal frame members 218A and 218B, there is a single square U-shaped piece 218', and the widths of the components forming the shoulder of the guitar have been reduced by about 50%. Part of the bridge 250 can be directly attached to a lower surface of the soundboard 602', e.g. by means of screws or the like. Thus, sound is transmitted to the board 602' via this bridge attachment as well as the transmitters 230.

The embodiments described above include body surfaces/sound boards that are substantially free of struts/braces. The substantially brace-free body achieves harmonious co-operation between the surfaces, resulting in enhanced resonant frequencies and levels. The frame-mounted transmitters enhance the process, enabling variation in tone outcome. A longer decay dwell is evidenced. The through body stringing arrangement enables greater string length and thus enhanced sustain. The composite bridge utilises a new combination of materials. The mechanically strong structure can enable to five-string version (a "wide five") to be constructed, with the fifth string being a bottom B.

The invention claimed is:

1. A stringed musical instrument having a body including a soundboard (602, 202), the instrument including a bridge (250) indirectly connected to the soundboard via a frame at least partially fitted within the body of the instrument, wherein the frame includes a platform (216) for supporting the bridge and a plurality of members (218, 220, 222, 224) extending from the platform that connect the platform to the body, and wherein the body includes a top (602) and a bottom (202) connected together by a plurality of members (232) arranged around the periphery of the body top and bottom.

2. An instrument according to claim 1, wherein a first part (218, 224) of the frame is connected to a portion of the body at, or adjacent, its shoulder/neck end (210) and another part of the frame (222, 224) is connected to a portion of the body at or adjacent an end of the body opposite the shoulder/neck end.

3. An instrument according to claim 1, wherein the frame (216) absorbs tension from strings (1000) of the instrument.

4. An instrument according to claim 1, wherein the frame (216, 518, 220, 222, 224) is formed of different materials than at least part of the body (602, 202).

5. An instrument according to claim 1, wherein a pair of said frame members (218A, 218B) extend from the platform (216) to an upper portion of a neck end portion (210) of the body, and a first one (218A) of the pair of members is located one side of a neck (212) location and the other one of the pair (218B) is located another side of the neck location.

6. An instrument according to claim 5, including a further said frame member (220) extending from the platform (216) to a lower portion of the neck (212) end portion of the body, the further frame member being located below the neck portion, between the pairs of frame members (218A, 218B).

7. An instrument according to claim 6, wherein at least one said frame member (222) extends from the platform (216) to a part of the body opposite the shoulder/neck (212) end.

8. An instrument according to claim 7, wherein the frame member (222) extending to a lower portion of the part of the body opposite the shoulder/neck end includes a plurality of bores (226), each said bore configured to accommodate a string (1000) of the instrument.

9. An instrument according to claim 6, wherein at least one of the frame members (224) extending to the part of the body opposite the neck end is connected to a cross piece (208) that extends across a bottom (202) of the body.

10. An instrument according to claim 1, wherein the body top (602) and bottom (202) connecting members (232) include a set of spaced-apart elongate members, e.g. a set of A-frames.

11. An instrument according to claim 1, wherein the body further includes a side wall (604) connected between the top (602) and the bottom, the side wall not being connected to the top and bottom connecting members (232).

12. An instrument according to claim 1, wherein the top (602) and/or the bottom (202) do not include bracings (106) configured to absorb string tension.

13. An instrument according to claim 1, wherein the top (602) is connected to the frame members and include at least one aperture (606) through which the bridge (250) at least partially protrudes.

14. An instrument, according to claim 1, including a plurality of the apertures (606') through the strings of the instrument are passed.

15. An instrument according to claim 1, wherein the bridge (250) is directly connected to a lower surface of the top (602) that forms at least part of the soundboard of the instrument.

16. An instrument according to claim 1, wherein the soundboard (602, 202) is connected to the frame (216, 518, 220, 222, 224) by at least one transmitter component (230).

17. An instrument according to claim 16, wherein the transmitter component (230) is formed of softwood.

18. An instrument according to claim 1, wherein a shoulder/neck end portion (210) of the body is formed of a solid/non-hollow member comprising of a plurality of pieces fixed together (702, 704, 706, 708, 710).

19. An instrument according to claim 1, wherein a bottom (202) of the body includes a recessed portion (206) configured to, in use, accommodate part of a body of a player.

20. An instrument according to claim 19, further including a rim member (204, 238) arranged around at least part of a periphery of an inner surface of a top (602) and/or bottom (202) of the body.

21. An instrument according to claim 20, wherein the rim member (204) runs around an inner boundary of the bottom recessed portion (206).

22. An instrument according to claim 1, wherein a top (602) of the body includes a recess (240) in a region configured to, in use, accommodate a wrist of a player.

23. An instrument according to claim 1, including a bridge (250) having a lower plate (802) formed of a lightweight alloy and a saddle (805) formed of an ivory substitute material.

24. An instrument according to claim 23, wherein the bridge (250) comprises a set of bridge protrusions (806) formed of a lightweight alloy, and a set of threaded members (808) extending perpendicularly from the protrusions.

25. An instrument according to claim 24, further including a set of string saddles (810) formed of an ivory substitute material and a support (812) for the saddles formed of nylon.

26. An instrument according to claim 1, wherein the instrument comprises a bass guitar.

27. A stringed musical instrument having a body including a soundboard (602, 202), the instrument including a bridge (250) indirectly connected to the soundboard via a frame at least partially fitted within the body of the instrument, wherein the frame includes a platform (216) for supporting the bridge and a plurality of members (218, 220, 222, 224) extending from the platform that connect the platform to the body, and wherein a bottom (202) of the body includes a recessed portion (206) configured to, in use, accommodate part of a body of a player.

28. A stringed musical instrument having a body including a soundboard (602, 202), the instrument including a bridge (250) indirectly connected to the soundboard via a frame at least partially fitted within the body of the instrument, wherein the frame includes a platform (216) for supporting the bridge and a plurality of members (218, 220, 222, 224) extending from the platform that connect the platform to the body, and wherein a top (602) of the body includes a recess (240) in a region configured to, in use, accommodate a wrist of a player.

* * * * *